US009440461B2

(12) United States Patent
Yamashita et al.

(10) Patent No.: US 9,440,461 B2
(45) Date of Patent: Sep. 13, 2016

(54) PRINTING APPARATUS

(71) Applicant: SCREEN HOLDINGS CO., LTD., Kyoto (JP)

(72) Inventors: Shinsuke Yamashita, Kyoto (JP); Hiroyuki Fuchioka, Kyoto (JP); Motoyuki Anno, Kyoto (JP)

(73) Assignees: RICOH COMPANY, LTD., Tokyo (JP); SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 14/430,899

(22) PCT Filed: Mar. 21, 2013

(86) PCT No.: PCT/JP2013/001927

§ 371 (c)(1),
(2) Date: Mar. 24, 2015

(87) PCT Pub. No.: WO2014/049900

PCT Pub. Date: Apr. 3, 2014

(65) Prior Publication Data

US 2015/0273875 A1 Oct. 1, 2015

(30) Foreign Application Priority Data

Sep. 28, 2012 (JP) ..... 2012-216666

(51) Int. Cl.
*B41J 11/00* (2006.01)
*B41J 15/16* (2006.01)

(52) U.S. Cl.
CPC ..... *B41J 11/007* (2013.01); *B41J 15/165* (2013.01)

(58) Field of Classification Search
CPC ..... B41J 11/007; B41J 15/165
USPC ..... 347/104
See application file for complete search history.

(56) References Cited

U.S. PATENT DOCUMENTS 5,592,881 A * 1/1997 Rabjohns ..... G06F 11/006 101/483
2007/0119317 A1* 5/2007 Takagi ..... B41J 11/0005 101/227

(Continued)

FOREIGN PATENT DOCUMENTS

JP 2001-113725 A 4/2001
JP 2008-216861 A 9/2008

(Continued)

OTHER PUBLICATIONS

International Search Report issued in International Application No. PCT/JP2013/001927 with Date of mailing May 14, 2013, with English Translation.

*Primary Examiner* — Stephen Meier
*Assistant Examiner* — Alexander D Shenderov
(74) *Attorney, Agent, or Firm* — McDermott Will & Emery LLP

(57) ABSTRACT

An inkjet printing apparatus is selectively composed of a plurality of transportation units, i.e., an inlet unit, a first intermediate unit, a second intermediate unit, and an outlet unit, having a transport path with slopes in side view of a transportation direction from a paper feeder to a take-up roller. When the transportation units are connected, a connecting part of the transportation unit is an inclination change point VP of the transport path. This achieves maintained tension to the print medium. As above, the inkjet printing apparatus may be selectively composed of a plurality of transportation units. Accordingly, the inkjet printing apparatus is constructible by combination of the units for various type productions, leading to a suppressed stock.

3 Claims, 7 Drawing Sheets

(56) References Cited

U.S. PATENT DOCUMENTS

| | | | |
|---|---|---|---|
| 2008/0218710 | A1 | 9/2008 | Taira et al. |
| 2010/0110134 | A1 | 5/2010 | Ohmura et al. |
| 2012/0093559 | A1 | 4/2012 | Vanheuverzwijn |

FOREIGN PATENT DOCUMENTS

| | | | |
|---|---|---|---|
| JP | 2010-105347 | A | 5/2010 |
| JP | 2011-056811 | A | 3/2011 |
| JP | 2012-081754 | A | 4/2012 |

* cited by examiner

PRINTING APPARATUS

RELATED APPLICATIONS

This application is a national phase of International Application No. PCT/JP2013/001927, filed on Mar. 21, 2013, which in turn claims the benefit of Japanese Application No. 2012-216666, filed on Sep. 28, 2012, the disclosures of which Applications are incorporated by reference herein.

TECHNICAL FIELD

The present invention relates to a printing apparatus that performs printing to a print medium while transporting the print medium from a supplying section to a discharge section.

BACKGROUND ART

In recent years, an inkjet printing apparatus has been widely used as a printing apparatus responding to diversification of printing information. In addition, an inkjet printing apparatus with a plurality of printing heads in a print-medium transportation direction has been produced for attaining high quality and speeding up. Moreover, an inkjet printing apparatus with a printing head, in addition to a plurality of printing heads, that performs printing in a special ink color, such as gold, or applies an overcoating agent. On the other hand, an inkjet printing apparatus with a standard resolution that requires no high quality and no speeding-up needs to be provided.

Among such apparatus, an inkjet printing apparatus with a standard resolution, an inkjet printing apparatus with high quality and speed, and an inkjet printing apparatus with high quality and speed as well as capability of printing with a special ink include, in this order, more numbers of printing head and a longer transport path of the print medium. Accordingly, a dedicated apparatus is provided for a specific application. See, for example, Japanese Patent Publication No. 2001-113725A.

[Patent Literature 1] Japanese Patent Publication No. 2001-113725A (FIG. 1)

SUMMARY OF INVENTION

Technical Problem

However, the examples of the currently-used apparatus with such constructions have the following problems.

That is, the currently-used apparatus each include a dedicated printing apparatus body for a specific application of the inkjet printing apparatus. This leads to an increased stock for various type inkjet printing apparatus. Such a problem arises.

The present invention has been made regarding the state of the art noted above, and its one object is to provide a printing apparatus that is applicable to various type productions and allows a suppressed stock by adopting a printing apparatus body having various combinations.

Solution to Problem

The present invention is constituted as stated below to achieve the above object. One embodiment of the present invention according to claim 1 discloses a printing apparatus performing printing to a print medium transported from a supplying section to a discharge section. The printing apparatus includes a printing apparatus body selectively composed of a plurality of transportation units, the transportation units having a transport path with given slopes in side view of a transportation direction from the supplying section to the discharge section. When the transportation units are connected, a connection part of the transportation units is an inclination change point of the transport path. When it is assumed that one of the plurality of transportation units adjacent to the supplying section is a first transportation unit, the first transportation unit includes a slope that inclines upward from a side adjacent to the supplying section to a side adjacent to the discharge section in side view of the transport path. When it is assumed that one of the plurality of transportation units adjacent to the discharge section is a second transportation unit, the second transportation unit includes a slope that inclines downward from the side adjacent to the supplying section to the side adjacent to discharge section in side view of the transport path. When it is assumed that one of the plurality of transportation units between the first transportation unit and the second transportation unit is a third transportation unit, the third transportation unit includes an inclination changing device, and when the third transportation unit is connected between the first transportation unit and the second transportation unit, one of the transportation units connected to the third transportation unit is an inclination change point and a vertex of the transport path. The inclination changing device allows change of inclination of the transport path from the supplying section to the discharge section upward or downward in side view of the transportation direction from the supply section to the discharge section.

Operation and Effect

With the embodiment according to claim 1, the printing apparatus body is selectively composed of a plurality of transportation units having the transport path with the slopes in side view of the transportation direction from the supplying section to the discharge section. When the transportation units are connected, the connecting part is the inclination change point of the transport path. This achieves maintained tension to the print medium. The printing apparatus body may be selectively composed of a plurality of transportation units. Accordingly, the printing apparatus is constructible by combination of the units for various type productions, leading to a suppress stock. Moreover, the third transportation unit is arranged between the first transportation unit and the second transportation unit. Then, the inclination changing device changes the inclination of the transport path of the third transportation unit. A downstream connecting part of the first transportation unit and the third transportation unit, a downstream connecting part of the third transportation unit and the second transportation unit, or a downstream connecting part of the third transportation units is a vertex as of the inclination change point of the transport path. Consequently, commonality of a plurality of third transportation units is obtained. Moreover, enhanced flexibility of arrangement is also obtainable, and a gap between the printing head and the print medium is readily controllable.

Here, the "connecting part" means a position where the transportation units are connected to each other, or a portion of a transport roller of the transportation unit adjacent to the connected position.

Moreover, the printing apparatus body in the embodiment of the present invention is preferably an inkjet printing apparatus that prints an image on the print medium by discharging ink droplets (claim 4).

In view of a printing system, the inkjet printing apparatus essentially maintains a gap between the print medium and the printing head accurately with maintained tension of the transport path. Consequently, the present invention is suitable for the printing apparatus body as an inkjet printing apparatus.

Advantageous Effects of Invention

With the printing apparatus according to the present embodiment, the printing apparatus body is selectively composed of a plurality of transportation units having the transport path with the slopes in side view of the transportation direction from the supplying section to the discharge section. When the transportation units are connected, the connecting part is an inclination change point of the transport path. This achieves maintained tension to the print medium. The printing apparatus body may be selectively composed of a plurality of transportation units. Accordingly, the printing apparatus is constructible by combination of the units for various type productions, leading to a suppressed stock. Moreover, the third transportation unit is arranged between the first transportation unit and the second transportation unit. Then, the inclination changing device changes the inclination of the transport path of the third transportation unit. A downstream connecting part of the first transportation unit and the third transportation unit, a downstream connecting part of the third transportation unit and the second transportation unit, or a downstream connecting part of the third transportation units is a vertex as of the inclination change point of the transport path. Consequently, commonality of a plurality of third transportation units is obtained. Moreover, enhanced flexibility of arrangement is also obtainable, and a gap between the printing head and the print medium is readily controllable.

DESCRIPTION OF EMBODIMENTS

The following describes one embodiment of the present invention with reference to drawings.

<First Device>

Figure 1:
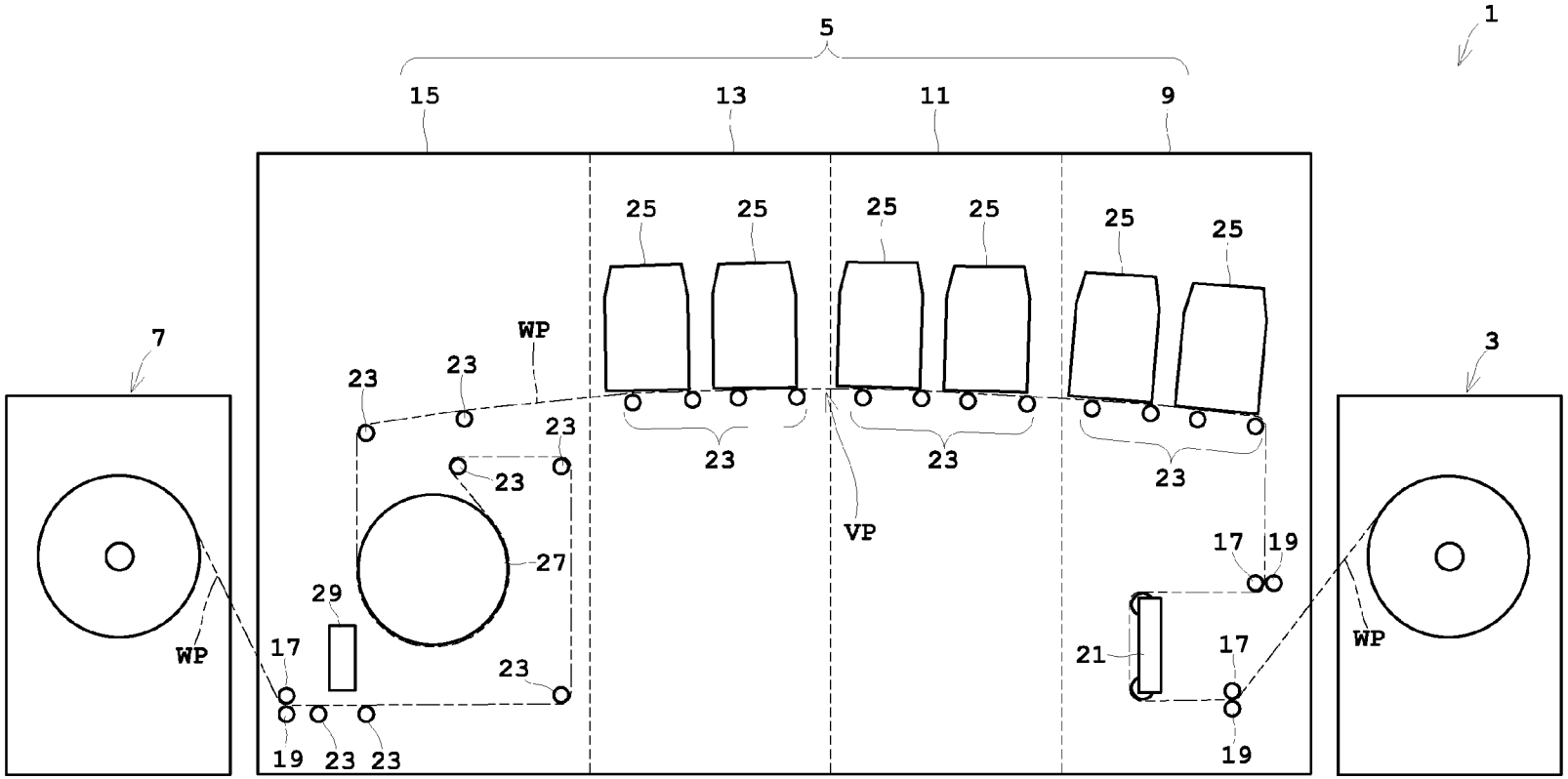
FIG. 1 is a side view schematically illustrating a first device according to one embodiment of the present invention.

FIG. 1 is a side view schematically illustrating a first device according to the embodiment.

The first device is, for example, a fully-optioned inkjet printing system 1 of high quality and speed.

The inkjet printing system 1 includes a paper feeder 3, an inkjet printing apparatus 5, and a take-up roller 7.

The paper feeder 3 holds web paper WP in a roll form to be rotatable about a horizontal axis, and unwinds the web paper WP to feed it to the inkjet printing apparatus 5. The inkjet printing apparatus 5 performs printing to the web paper WP. The take-up roller 7 winds up the web paper WP printed by the inkjet printing apparatus 5 about a horizontal axis. Regarding a side from which the web paper WP is fed as upstream and a side to which the web paper WP is taken up as downstream, the paper feeder 3 is disposed upstream of the inkjet printing apparatus 5 while the take-up roller 7 is disposed downstream of the inkjet printing apparatus 5.

Here, the web paper WP corresponds to the "print medium" in the present invention. The paper feeder 3 corresponds to the "supplying section" in the present invention. The take-up roller 7 corresponds to the "discharge section" in the present invention.

The inkjet printing apparatus 5 includes an inlet unit 9, a first intermediate unit 11, a second intermediate unit 13, and an outlet unit 15, in this order, from a side adjacent to the paper feeder 3. The inkjet printing apparatus 5 is formed by the above units 9, 11, 13, and 15 selectively connected as appropriate. Here, the first device includes all of the above units.

The inkjet printing apparatus 5 corresponds to the "printing apparatus body" in the present invention.

The inlet unit 9 includes a drive roller 17, a nip roller 19, an edge position controller 21, a drive roller 17, a nip roller 19, four transport rollers 23, and two inkjet heads 25, in this order, from the side adjacent to the paper feeder 3. The drive roller 17 and the nip roller 19 take up the web paper WP from the paper feeder 3. The edge position controller 21 corrects a position of the web paper WP automatically when the web paper WP serpentines, whereby the web paper WP is transported correctly. The four transport rollers 23 contact a lower surface of the web paper WP for smoothly transporting the web paper WP. The inkjet head 25 discharges ink droplets to the web paper WP to form a printing image. Here, an upstream inkjet head 25 discharges ink droplets in black (K), and a downstream inkjet head 25 discharges ink droplets in cyan (C). The four transport rollers 23 form a "transport path" by upper edges thereof for transporting the web paper WP. The transport path of the inlet unit 9 inclines upward from the side adjacent to the paper feeder 3 to the side adjacent to the take-up roller 7.

The first intermediate unit 11 includes four transport rollers 23 and two inkjet heads 25. The two inkjet heads 25 include an upstream one discharging ink droplets in magenta (M), and a downstream one discharging ink droplets in yellow (Y).

The second intermediate unit 13 has the same construction as the first intermediate unit 11 mentioned above. That is, the second intermediate unit 13 includes four transport rollers 23 and two inkjet heads 25. The two inkjet heads 25 includes an upstream one discharging ink droplets in gold, and a downstream one discharging an overcoating agent. The overcoating agent overcoats and protects a surface of the printing image.

The outlet unit 15 includes a transport roller 23, a heat drum 27, a transport roller 23, an inspecting unit 29, a drive roller 17, and a nip roller 19 in this order from the upstream of the transport path. The heat drum 27 contains a heater embedded therein. The heat drum 27 rotates in association with the transportation of the web paper WP. The heat drum 27 dries the ink droplets discharged on the web paper WP through heating. The inspecting unit 29 inspects the printed image on the surface of the web paper WP for any printing defect, such as stains or omissions. The two transport rollers 23 upstream of the heat drum 27 forms a "transport path" by upper edges thereof for transporting the web paper WP. The transport path of the outlet unit 15 inclines downward from the side adjacent to the paper feeder 3 to the side adjacent to the take-up roller 7.

The inlet unit 9 corresponds to the "first transportation unit" in the present invention. The outlet unit 15 corresponds to the "second transportation unit" in the present invention. The intermediate unit 11 and the second intermediate unit 13 correspond to the "third transportation unit" in the present invention.

As mentioned above, the inkjet printing apparatus 5 of the inkjet printing system 1 includes the inlet unit 9, the first and second intermediate units 11 and 13, and the outlet unit 15. A connecting part of the first and second intermediate units 11 and 13 is an inclination change point and a vertex VP of the transport path upon transportation of the web paper WP. Here, the connecting part is the inclination change point and the vertex VP of the transport path. This achieves maintained tension to the web paper WP. Alternatively, the inclination change point and the vertex VP of the transport path may exist both between the first and second intermediate units 11 and 13 and between the second intermediate unit 13 and the outlet unit 15.

<Second Device>

Figure 2:
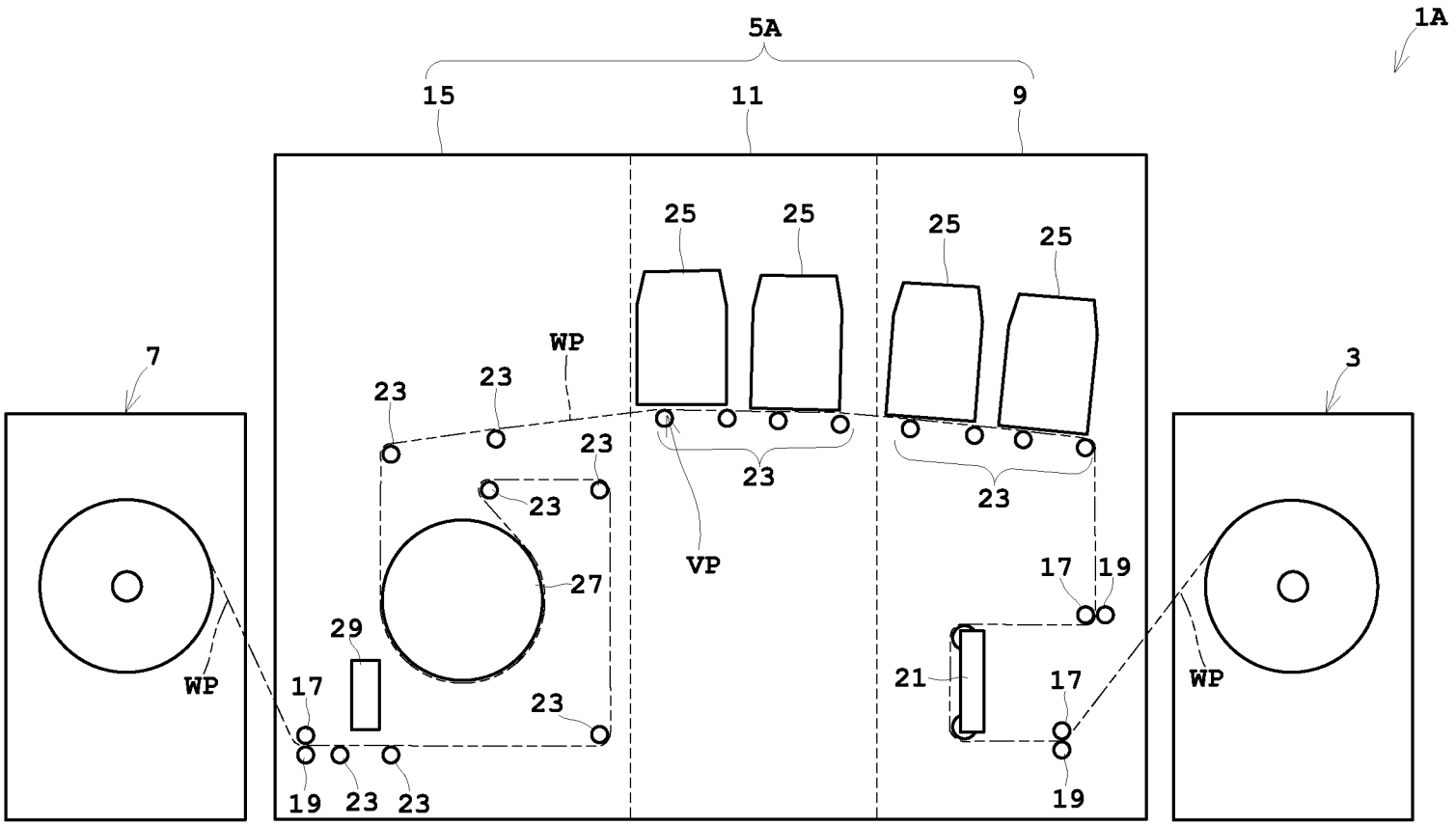
FIG. 2 is a side view schematically illustrating a second device according to the embodiment.

FIG. 2 is a side view schematically illustrating a second device according to the embodiment.

The second device is an inkjet printing system 1A with the second intermediate unit 13 mentioned above removed from the inkjet printing system 1. The inkjet printing system 1A includes a paper feeder 3, an inkjet printing apparatus 5A, and a take-up roller 7. The inkjet printing apparatus 5A has a standard specification with no discharge of special ink droplets and performance of overcoating.

The inkjet printing apparatus 5A is composed of an inlet unit 9, a first intermediate unit 11, and an outlet unit 15. Among these units, a connecting part of the first intermediate unit 11 and the outlet unit 15 is an inclination change point VP of a transport path upon transportation of the web paper WP. Specifically, a transport roller 23 downstream of the first intermediate unit 11 is the inclination change point VP.

<Third Device>

Figure 3:
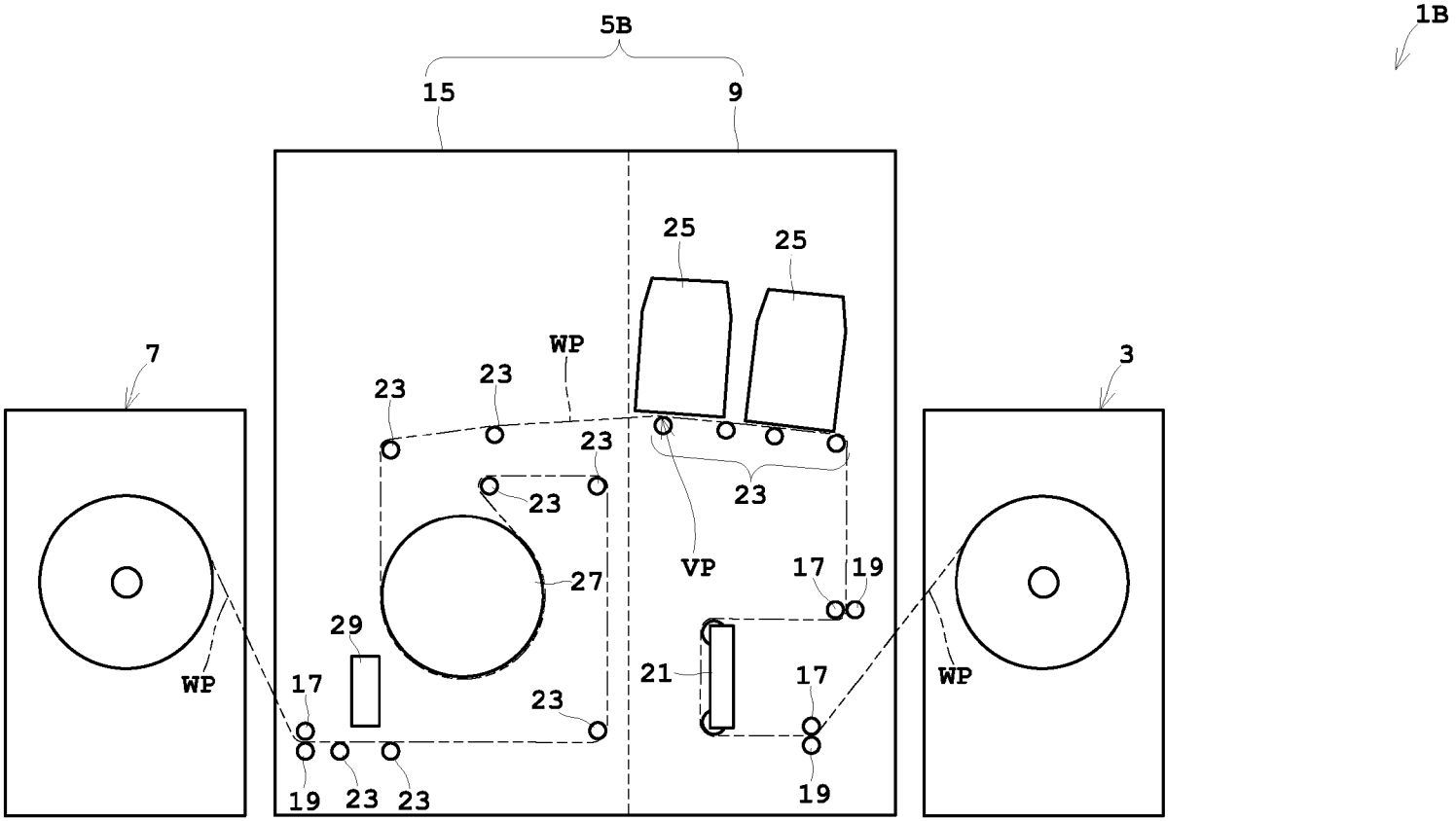
FIG. 3 is a side view schematically illustrating a third device according to the embodiment.

FIG. 3 is a side view schematically illustrating a third device.

The third device is an inkjet system 1B with the first intermediate unit 11 removed from the inkjet printing system 1A. The inkjet printing system 1B includes a paper feeder 3, an inkjet printing apparatus 5B, and a take-up roller 7. The inkjet printing apparatus 5B has two inkjet head 25 for black (K) only.

The inkjet printing apparatus 5B is composed of an inlet unit 9 and an outlet unit 15. A connecting part of the inlet unit 9 and the outlet unit 15 is an inclination change point VP of the transport path upon transportation of the web paper WP. Specifically, a transport roller 23 downstream of the inlet unit 9 is the inclination change point VP.

In the present embodiment mentioned above, the inkjet printing apparatus 1 (1A and 1B) is selectively composed of a plurality of units, i.e., the inlet unit 9, the first intermediate unit 11, the second intermediate unit 13, and the outlet unit 15. The units have a transport path with given slopes in side view of the transportation direction from the paper feeder 3 to the take-up roller 7. When the units are connected to each other, the connecting part is an inclination change point VP of the transport path. This achieves maintained tension to the print medium. The inkjet printing apparatus 1 (1A and 1B) is selectively composed of a plurality of units. Accordingly, the inkjet printing apparatus 1 (1A and 1B) is constructible by combination of the units for various type productions, leading to a suppressed stock.

Figure 4:
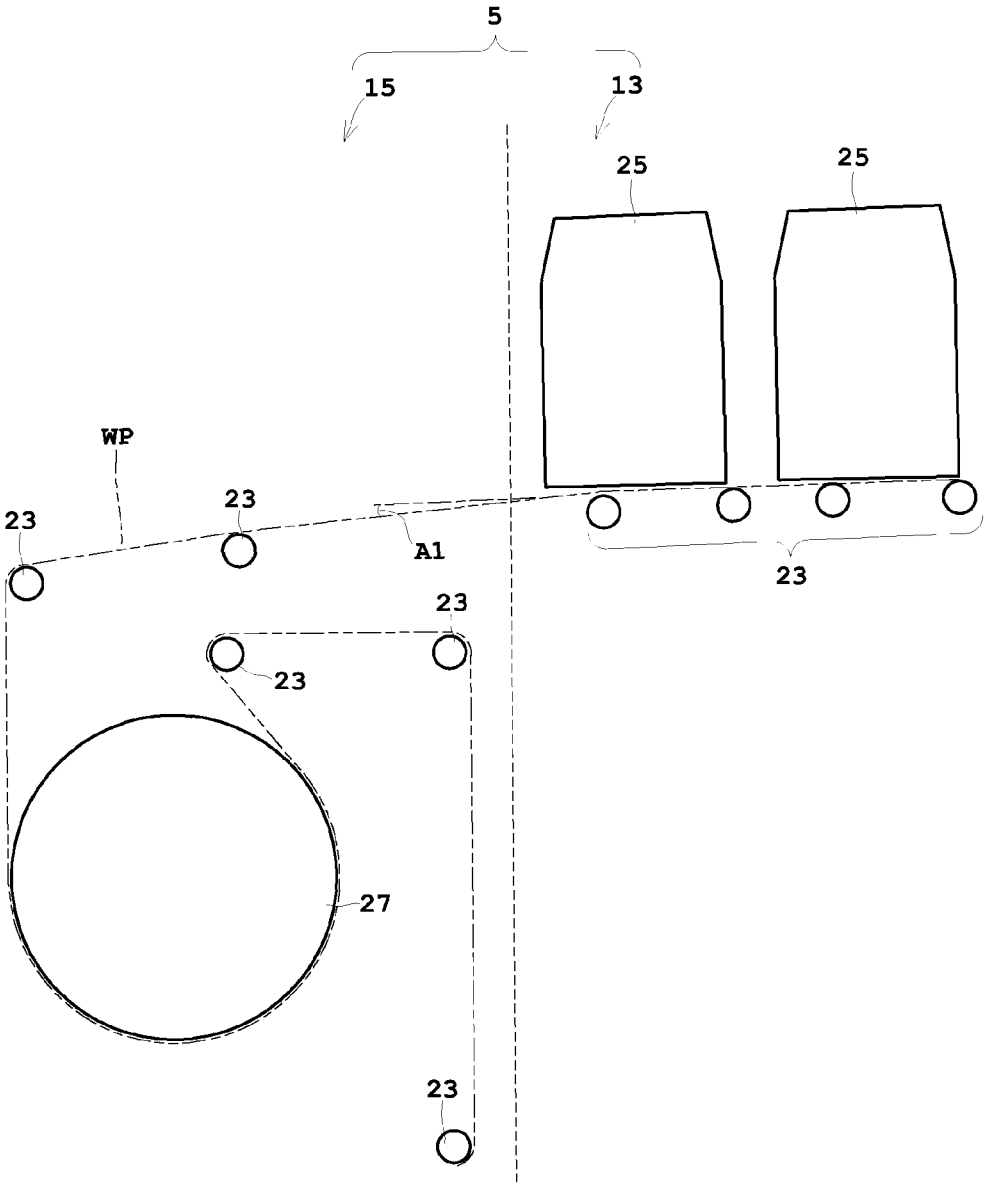
FIG. 4 is an enlarged view around an outlet of the first device.
Figure 5:
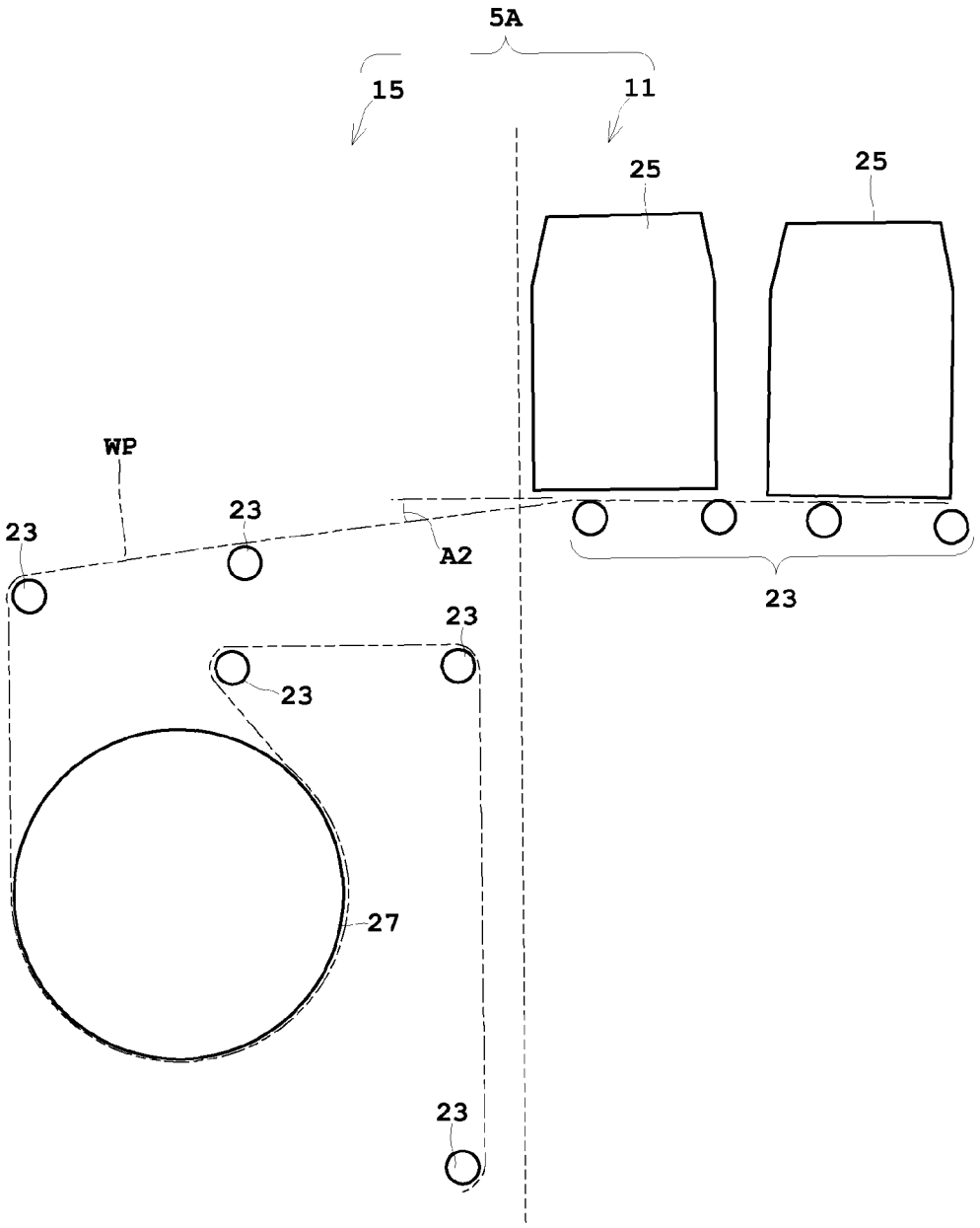
FIG. 5 is an enlarged view around an outlet of the second device.
Figure 6:
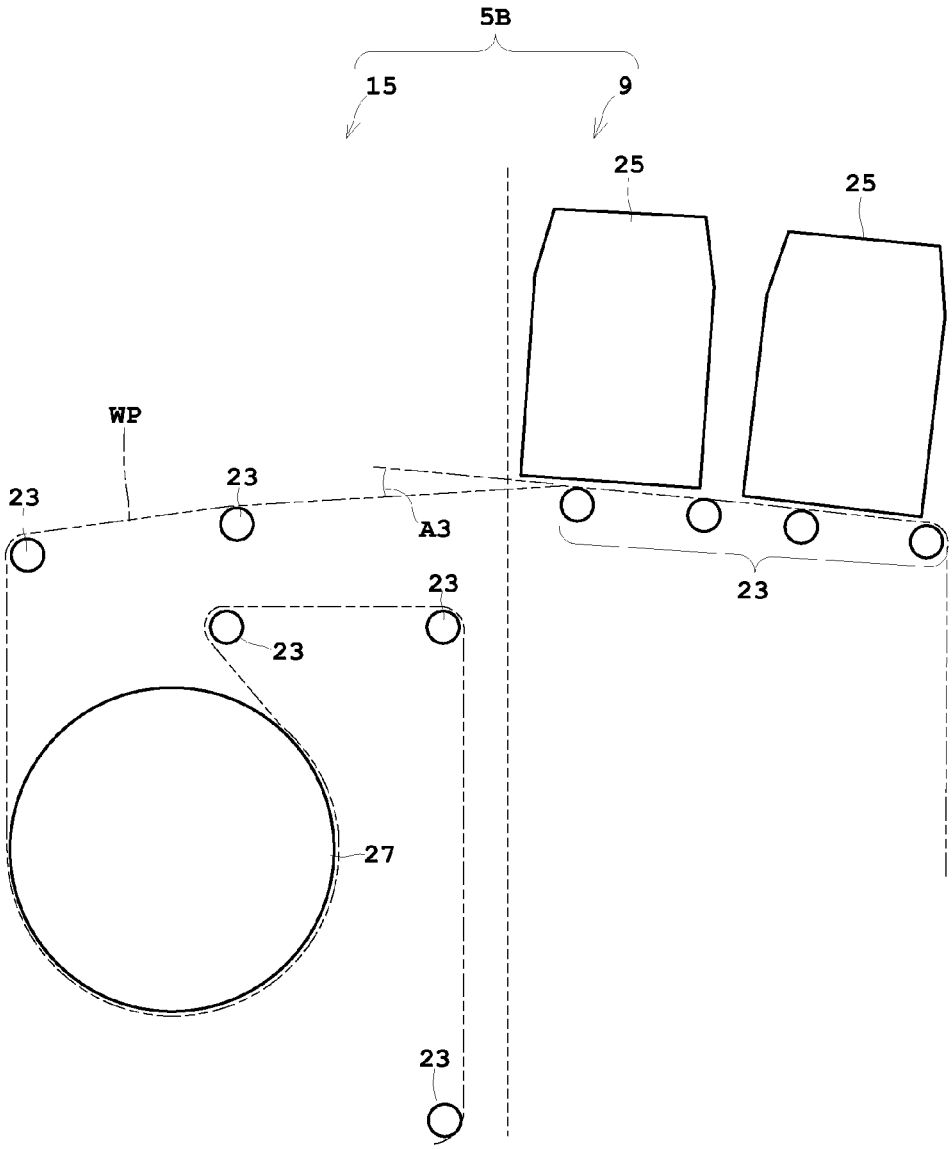
FIG. 6 is an enlarged view around an outlet of the third device.

Now reference is made to FIGS. 4 to 6 for describing an angle of the transport path in the outlet unit 15 of the first to third devices. FIG. 4 is an enlarged view around an outlet of the first device. FIG. 5 is an enlarged view around an outlet of the second device. FIG. 6 is an enlarged view around an outlet of the third device.

In the inkjet printing apparatus 1 as the first device, A1 denotes an angle of a transport path (by chain double-dashed lines indicating the web paper WP) and a horizontal line extending from upper edges of the two transport rollers 23 in the second intermediate unit 13. In the inkjet printing apparatus 1A as the second device, A2 denotes the above angle. In the inkjet printing apparatus 1B as the third device, A3 denotes the above angle. In this case, the angles has a relation A3>A2>A1. Specifically, A1 is 8.1°, A2 is 8°, and A3 is 2.3°.

The angles A1 to A3 by which the transportation path on the transport roller 23 inclines downward in the outlet unit 15 each achieve accurately maintained tension in a printing position of the web paper WP.

Figure 7:
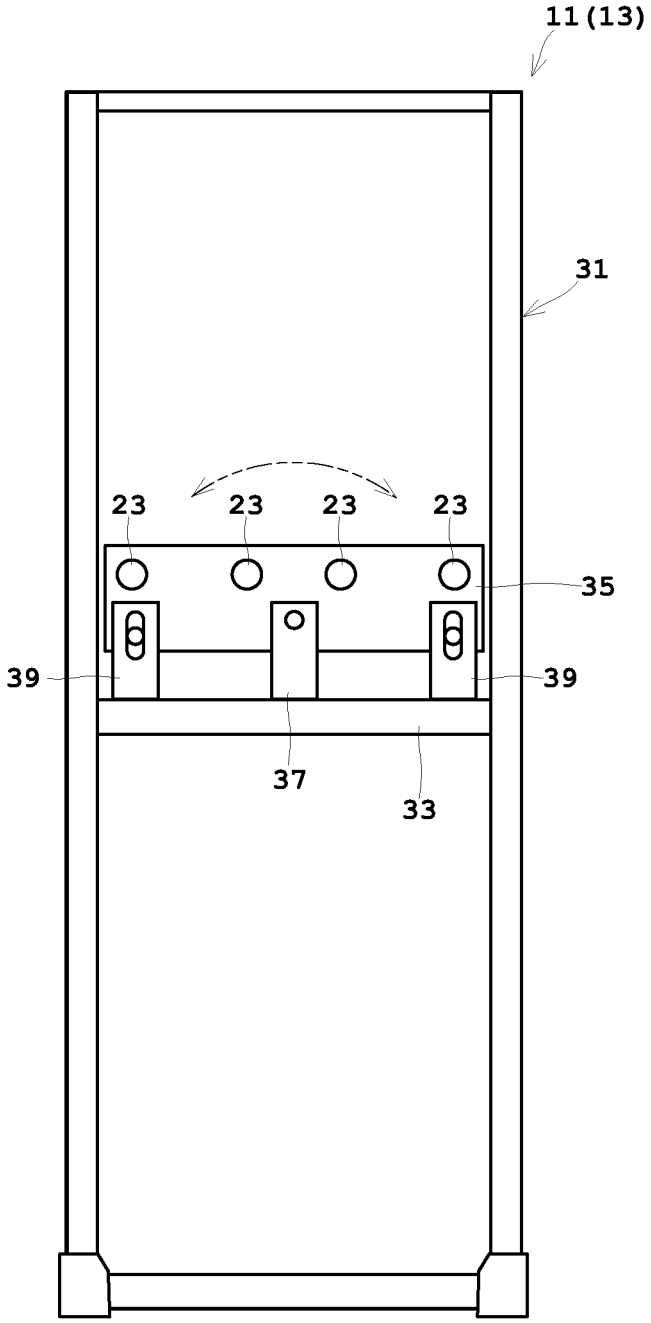
FIG. 7 is a side view of a principal part of an intermediate unit.

Now reference is made to FIG. 7 for describing a principal part of the first intermediate unit 11 (second intermediate unit 13). FIG. 7 is a side view illustrating a principal part of the intermediate unit.

The first intermediate unit 11 has the same principal part as the second intermediate unit 13 in construction, and thus the first intermediate unit 11 is to be described as one example.

The first intermediate unit 11 includes a frame 31, a horizontal frame 33, a roller holding frame 35, a pivot frame 37, and a swing holding frame 39.

The frame 31 forms an outline of the first intermediate unit 11. The horizontal frame 33 is arranged horizontally at an intermediate level position of the frame 31. The roller holding frame 35 rotatably holds four transport rollers 23. The roller holding frame 35 is attached to the horizontal frame 33 so as to swing by the pivot frame 37. The swing holding frame 39 fixes the roller holding frame 35 swung in the above manner at a given swinging attitude.

The roller holding frame 35, the pivot frame 37, and the swing holding frame 39 correspond to the "inclination changing device" in the present invention.

With the above construction, the intermediate unit 11 allows the transport roller 23 to be in a given inclined attitude. Consequently, commonality of the first and second intermediate units 11 and 13 is obtainable.

The present invention is not limited to the foregoing examples, but may be modified as follows.

(1) In the present embodiment mentioned above, the web paper WP is described as one example of the print medium. However, the print medium in the present invention is not limited to the web paper WP. For instance, cut paper is applicable. Moreover, the print medium is not limited to paper. For instance, a film is applicable.

(2) In the present embodiment mentioned above, the inkjet printing apparatus 1 includes up to four units. However, the present invention is not to this, For instance, three or more intermediate unit may be arranged.

(3) In the present embodiment mentioned above, the inkjet printing apparatus is described as one example of the printing apparatus. However, the present invention is not limited to such an inkjet printing apparatus.

INDUSTRIAL APPLICABILITY

As noted above, the present invention is suitable for a printing apparatus performing printing to a print medium while transporting the print medium from a supplying section to a discharge section.

REFERENCE SIGNS LIST

1, 1A, 1B . . . inkjet printing system
3 . . . paper feeder
5, 5A, 5B . . . inkjet printing apparatus
7 . . . take-up roller
9 . . . inlet unit
11 . . . first intermediate unit
13 . . . second intermediate unit
15 . . . outlet unit
23 . . . transport roller
25 . . . inkjet head
27 . . . heat drum
VP . . . change point and vertex

The invention claimed is:

1. A printing apparatus performing printing to a print medium transported from a supplying section to a discharge section, the printing apparatus comprising:

a printing apparatus body selectively composed of a plurality of transportation units, the transportation units having a transport path with given slopes in side view of a transportation direction from the supplying section to the discharge section, upon connection of the transportation units, a connection part between two of the transportation units containing a slope change portion of the transport path, when it is assumed that one of the plurality of transportation units adjacent to the supplying section is a first transportation unit, the first transportation unit includes a slope that inclines upward from a side adjacent to the supplying section to a side adjacent to the discharge section in side view of the transport path, when it is assumed that one of the plurality of transportation units adjacent to the discharge section is a second transportation unit, the second transportation unit includes a slope that inclines downward from the side adjacent to the supplying section to the side adjacent to discharge section in side view of the transport path, when it is assumed that one of the plurality of transportation units between the first transportation unit and the second transportation unit is a third transportation unit, the third transportation unit includes an inclination changing device to connect the first transportation unit and the second transportation unit which respectively have differently inclined slopes from each other, when the third transportation unit is connected between the first transportation unit and the second transportation unit, a connection part between the third transportation unit and one of the transportation units connected to the third transportation unit is the inclination change portion point and a vertex of the transport path, and the inclination changing device allows change of inclination of the transport path from the supplying section to the discharge section upward or downward in side view of the transportation direction from the supply section to the discharge section, the inclination changing device includes:

a roller holding frame holding a plurality of transport rollers;

a pivot frame swinging the roller holding frame rightward and leftward when the transport path is seen in side view; and a swing holding frame fixing the roller holding frame swung by the pivot frame at a given swinging attitude.

2. The printing apparatus according to claim 1, wherein the printing apparatus body is an inkjet printing apparatus that prints an image on the print medium by discharging ink droplets.

3. The printing apparatus according to claim 1, wherein the connection part between the third transportation unit and one of the transportation units connected to the third transportation unit is a portion where the third transportation and the one of the transportation units are directly connected to each other not through another transportation unit, and the portion is the inclination change portion.

* * * * *